US005458470A

United States Patent [19]

Mannhart et al.

[11] Patent Number: 5,458,470

[45] Date of Patent: Oct. 17, 1995

[54] PUMPING APPARATUS

[75] Inventors: Othmar Mannhart, Winterthur; Otto Tschumi, Frauenfeld, both of Switzerland

[73] Assignee: Sandoz Ltd., Basel, Switzerland

[21] Appl. No.: 144,088

[22] Filed: Oct. 27, 1993

Related U.S. Application Data

[63] Continuation-in-part of Ser. No. 884,682, May 18, 1992, abandoned.

[30] Foreign Application Priority Data

May 16, 1991 [DE] Germany ..... 41 15 945.4
May 16, 1991 [DE] Germany ..... 41 15 944.6

[51] Int. Cl.[6] ..... F04B 7/10; F04B 15/02

[52] U.S. Cl. ..... 417/517; 417/900

[58] Field of Search ..... 417/347, 345, 417/517, 519, 900, 53

[56] References Cited

U.S. PATENT DOCUMENTS

| | | | |
|---|---|---|---|
| 3,507,347 | 4/1970 | Bennett | 417/900 X |
| 3,778,193 | 12/1973 | Reinert | 417/342 |
| 4,343,598 | 8/1982 | Schwing et al. | 417/519 X |
| 4,533,300 | 8/1985 | Westerlund et al. | 417/517 X |
| 4,566,858 | 1/1986 | Akiba | 417/22 |
| 4,893,922 | 1/1990 | Schlecht | 417/517 X |
| 5,106,272 | 4/1992 | Oakley et al. | 417/347 |

FOREIGN PATENT DOCUMENTS

| | | | |
|---|---|---|---|
| 0334994 | 10/1989 | European Pat. Off. . | |
| 2117283 | 6/1992 | France . | |
| 1653406 | 10/1970 | Germany . | |
| 2010112 | 12/1971 | Germany . | |
| 2841514 | 4/1980 | Germany . | |
| 3525003 | 1/1987 | Germany . | |
| 59-226287 | 12/1984 | Japan | 417/517 |
| 62-147054 | 7/1987 | Japan | 417/519 |
| 1360800 | 11/1971 | United Kingdom . | |
| WO83/01983 | 6/1983 | WIPO . | |
| WO90/04104 | 4/1990 | WIPO . | |

OTHER PUBLICATIONS

Derwent Abstract for: WO 90/04104.
Derwent Abstracts for: SU 354300 DE 1653406 DE 2841514 US 3778193.
Page of Mannesman–Rexroth catalog depicting a series of "Proportional–directional control valves".

*Primary Examiner*—Richard E. Gluck
*Attorney, Agent, or Firm*—Robert S. Honor; Richard E. Vila; Andrew N. Parfomak

[57] ABSTRACT

A pumping apparatus of the type comprising twin cylindrical pumping chambers which alternately take in and deliver material to be pumped, the taking in being via ports in a common feeding chamber and the delivery being via a delivery conduit which moves to the port of the chamber which is to deliver. The pumping is carried out by hydraulically-actuated pumping pistons in the chambers, the hydraulic circuitry being adapted to ensure that the pumping piston in that chamber taking in material arrives at the fully charged position before the delivering chamber attains the fully discharged position. In another embodiment, the pumping apparatus comprises a "push-over" facility, wherein the speed of the pumping is automatically increased to compensate for the drop in flow rate caused by the time taken by the delivery conduit to move from one port to the other. The apparatus gives an exceptionally pulsation-free flow and is especially useful in concrete spraying apparatus.

13 Claims, 3 Drawing Sheets

PUMPING APPARATUS

This application is a continuation-in-part application of U.S. Ser. No. 07/884,682 filed 18, May 1992, now abandoned.

This invention relates to an apparatus for the pumping of fluid materials. More particularly it relates to the use of such an apparatus in the wet spraying of concrete and to a process of applying concrete.

It is a requirement in a number of fields that a fluid material be pumped continuously, with little or no fluctuation in the stream of pumped material. One such field is that of concrete spraying, used, for example, in the coating of tunnel walls.

Conventional apparatus used for the spraying of concrete commonly comprise two pumping chambers, one of which, the "delivery chamber" pumps material while the other chamber, the "intake chamber" fills with material, this filling being completed when the delivery chamber is empty. The delivery and intake chambers then reverse roles and the procedure starts again. The role reversal may be achieved by a variety of means. One form of apparatus in common use is one comprising two parallel cylindrical pumping chambers within which pistons move, which pumping chambers open via ports into a common filling chamber, usually an open hopper, into which the material to be pumped is introduced. The operation of the pistons are associated with hydraulic pistons and cylinder units whose operation is synchronized, such that the filling of one chamber occurs simultaneously with the emptying of the other chamber. The material being emptied from the chamber is forced through a delivery conduit whose end alternately oscillates between the ports, and fits tightly thereon while the cylinder is emptying. In such a manner, the pumped material may be ejected from the apparatus while at the same time the other cylinder fills with the material in the hopper. When the delivery chamber is empty, the end of the delivery conduit is moved from the port of the depleted cylinder to the port of the other cylinder which is then completely full and is about to discharge.

A satisfactorily smooth delivery of material is not possible with the existing apparatus of the type hereinabove described because the change-over of the delivery conduit from one port to the other inevitably takes time, leading to a break in the delivery of material.

It has now been found that breaks in delivery can be substantially avoided by a pumping apparatus of the type hereinunder described. According to the present invention there is provided a pumping apparatus comprising two cylindrical pumping chambers one of which, the "intake chamber" is being charged with material to be pumped while the other of which, the "delivery chamber" is discharging material, the intake chamber becoming the delivery chamber and vice versa when the intake chamber is full and the delivery chamber is empty, the material to be charged entering the intake chamber via a port in a common charging chamber and discharged by means of a discharge conduit whose end oscillates between the ports and is a tight fit thereon, the conduit being adapted to cover the port of a chamber which is about to discharge, and to move to the port of the other chamber when discharge is complete, discharge being effected by means of associated hydraulic piston and cylinder units and an associated hydraulic circuit, characterised in that, in operation, the hydraulic circuit acts upon the associated piston and cylinder units so as to bring the piston in the intake chamber to a position in which the intake chamber is fully charged before the piston in the delivery chamber reaches a position in which the material therein is fully discharged.

The mechanism by which the pump operates, except for the hydraulic circuit, is conventional and the skilled person will readily comprehend what type of apparatus may be used. Typical examples of such apparatus are found in the "Meycojet" (trade mark) 082 EH series of concrete spraying machines marketed by Meynadier AG of Winterthur, Switzerland. In this type of apparatus, which is the preferred apparatus for the purposes of this invention, the pumping chambers have associated hydraulic piston and cylinders units wherein the pistons of the pumping chambers share a common shaft with the pistons in the associated hydraulic piston and cylinder units. Movement of the pistons in hydraulic piston and cylinder units thus causing corresponding movement of the pumping chamber pistons.

In accordance with one aspect of the instant invention, there is associated with the apparatus an automatic means which reverses the direction of movement of the pistons in the pumping chambers and which simultaneously causes the discharge conduit to move from the chamber which has just completed discharge to the chamber which is about to commence discharge. This is preferably an electrical or electronic circuit with sensing and/or actuating means which is responsive to the arrival of a hydraulic piston in a hydraulic piston and cylinder unit at a position corresponding to the full discharge position of the associated pumping chamber which signal means then initiates the reversal of the movement directions of the pumping chamber piston and change-over of the discharge conduit to the other other port. Suitable electrical or electronic circuits with sensing and/or actuating means for achieving such a result include electrical switches and are already well known in the art, and may be incorporated into the inventive apparatus as being described herein.

An innovative feature of the apparatus according to the invention is in the action of the hydraulic circuit to bring the piston in an intake chamber to the fully charged position before the delivery chamber has reached a fully discharged position. In such a manner, the intake cylinder is charged more rapidly than would be realized with conventionally known and used apparatus which do not provide this feature, and further, allows for the equlization of pressure between the cylinder and the hopper to take place. As is frequently the case, the pressure of the hopper is usually the same as that at the outlet of the discharge tube, and thus, the pressure drop across the port end of a delivery chamber at the initiation of a pumping stroke is minimized. A further advantageous aspect of such operation is that as an intake cylinder is fully charged and pressure equalized, pumping may begin the instant the end of the delivery tube is positioned over the port, thus minimizing any time lag in the delivery of the pumping material.

In accordance with one aspect of the invention, the movement of the hydraulic pistons in the hydraulic pistion and cylinder units, hereinafter interchangeably referred to as "hydraulic units" are, regulated by a hydraulic circuit which supplies a sufficient excess of hydraulic fluid at one side of cylinder of a hydraulic unit which is associated with the intake chamber. The presence of such additional fluid accelerates the stroke of the hydraulic piston and its corresponding intake chamber piston. When the intake chamber piston has reached the end of its stroke, the excess fluid is drained away. When the delivery chamber is fully discharged, the chambers reverse roles and the same procedure repeats.

In a further aspect of the invention, the pumping apparatus may further include a "transition-delivery control"

system. In this system, the initial pumping speed of the delivery chamber is made faster than usual, thus temporarily raising the volumetric or mass delivery rate of the material being pumped above that of the nominal delivery rate of the pumping apparatus. The increase in the amount of additional material being pumped in excess of the nominal delivery rate for this delivery stroke is preferably an amount which compensates exactly for the diminution in flow experienced during the change-over of chambers immediately prior to the initiation of the same delivery stroke.

In certain known art-recognized processes, the mass and/or volume of the additional flow and the time taken to return to normal is controlled manually. While adequate for some cases, in others it may be unsatisfactory, as in the spraying of concrete, or other heavy and/or highly viscous materials. For example, concretes come in different consistencies and compositions and it is beyond the skill of most operators to achieve a consistent result. Further, other operating variables including pressures and temperatures which may effect the operation of the apparatus are further variables which would need be compensated for but, which are difficult to control manually.

Thus, in a further aspect of the present invention, these and other shortcomings in the art may be overcome and a virtually pulsation-free flow achieved by maybe means of a pumping apparatus having two cylindrical pumping chambers, one of which (the intake chamber) takes in material to be pumped while the other (the delivery chamber) pumps material, the intake chamber becoming the delivery chamber and vice versa when the intake chamber is full and the delivery chamber is empty (the change-over), the pumping and taking in of material being effected by means of hydraulically-urged pumping pistons moving in the chambers, change-over being achieved by means of a hydraulic valve, characterised in that there is associated with the valve automatic means which governs the output of the delivery chamber with reference to a function of the flow rate such that the initial flow rate is increased to such an extent and for such a time that it compensates for the decrease in flow rate of material during the change-over.

The invention is further illustrated by means of the drawings.

Figure 1:
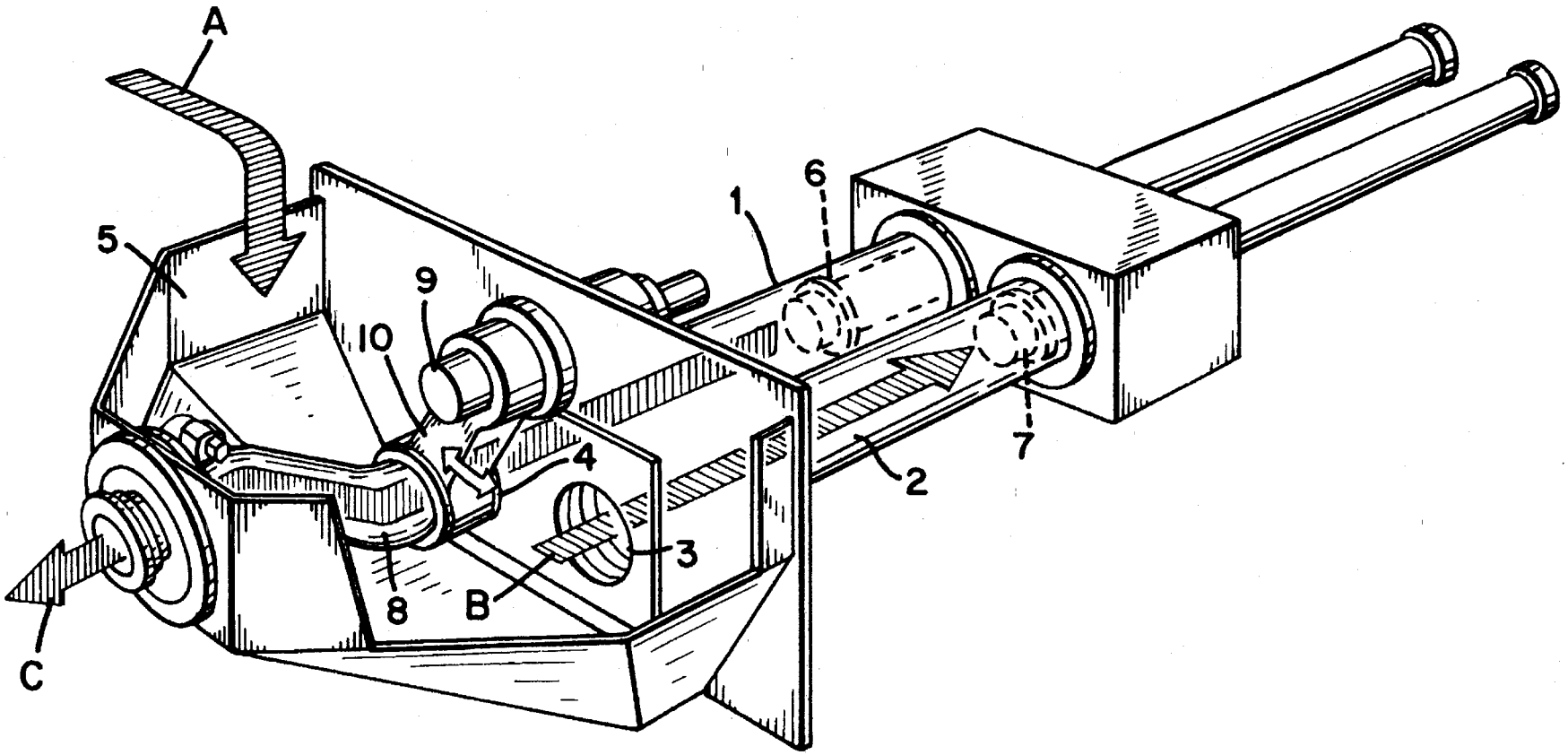
FIG. 1 is a perspective, part-ghosted view of part of a pumping apparatus.

Turning to FIG. 1, therein are depicted two cylindrical pumping chambers 1 and 2 open via ports 3 and 4 with a hopper 5 into which material to be pumped is charged. Within these pumping chambers move pumping pistons 6 and 7, these serving to draw in or discharge material to be pumped, one piston discharging while the other is drawing. Within the hopper 5 a delivery conduit 8 pivots about a pivot 9 by means of a connecting arm 10, as in the direction depicted by the double-headed white arrow, and which is adapted to be moved by an appropriate means (not shown) such as by two opposing hydraulic cylinders whose pistons are linked to the pivot 9 between the ports 3 and 4 which it tightly covers. Other conventional means for moving the delivery conduit 8 may also be used although are not elucidated here. The mode of operation of the apparatus is depicted with reference to the shaded arrows "A", "B", and "C". "A" depicts the addition of material to the hopper. The port 3 of chamber 2 is open to the hopper and the piston 7 moves away from the port, drawing in material, as depicted by "B". At the same time, the piston 6 in the chamber 1 advances towards the port 4, pushing out of the chamber material which has previously been drawn therein. The delivery conduit covers the port 4 and material is discharged from the apparatus via this conduit as depicted by "C".

Figure 2:
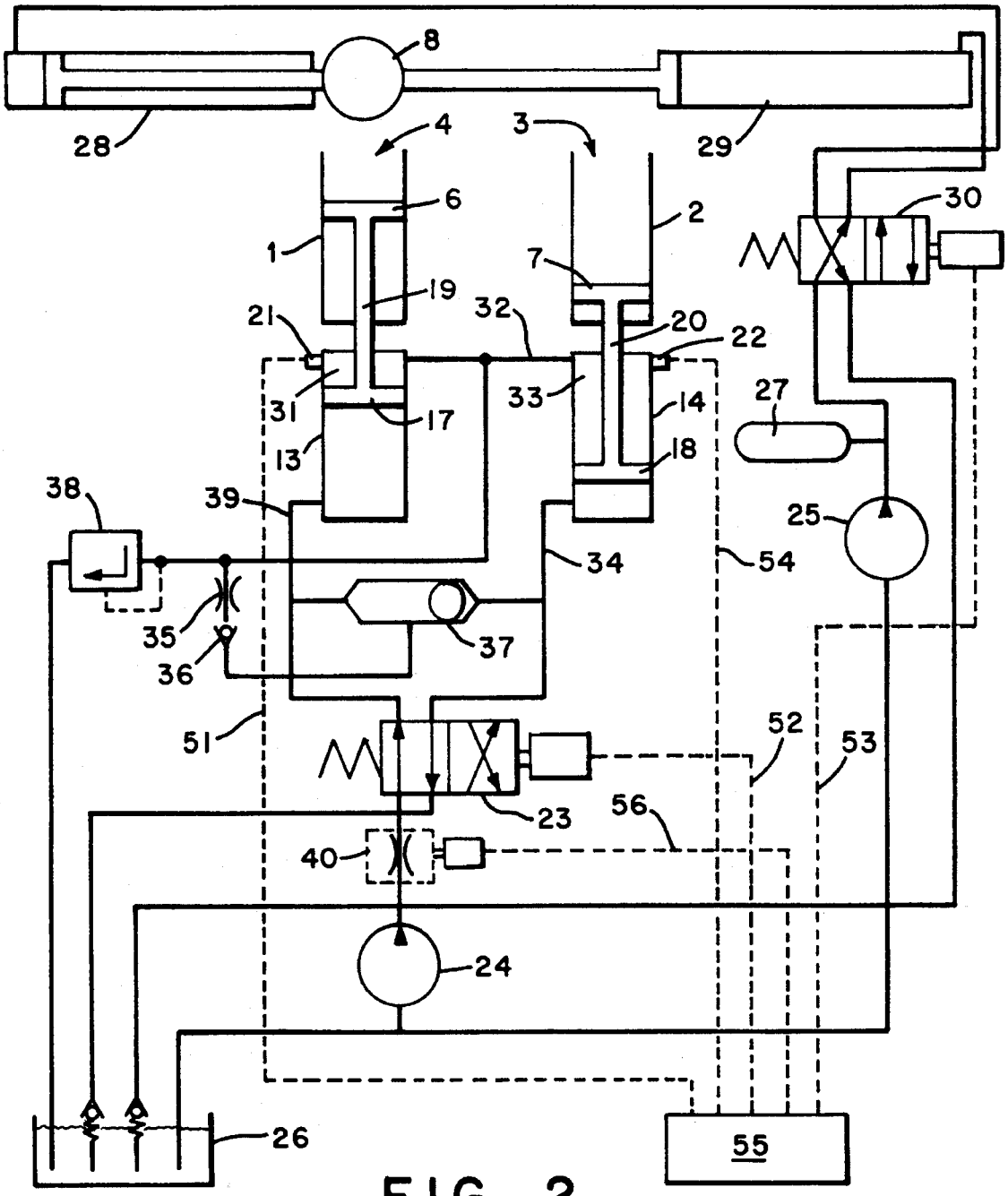
FIG. 2 is a diagrammatic representation of the hydraulic circuit of a pumping apparatus according to the invention, together with the hydraulic circuit which effects and which hydraulic circuit further incorporates an electrical/electronic control circuit.

With reference now to FIG. 2, thereon is depicted a preferred embodiment of the present invention. As is thereon illustrated, a pair of pumping chambers 1 and 2, each of which have an associated hydraulic piston and cylinder unit 13 and 14. Each pumping chamber includes a pumping piston 6, 7 which is associated with and connected to a corresponding hydraulic piston 17, 18 by a shaft .19, 20, such that hydraulically-actuated movement of the hydraulic pistons causes movement of their associated pumping pistons in the pumping chambers. Mounted near the end of each hydraulic cylinder is a switch means, here electronic sensors 21, 22 which detects the arrival of the hydraulic piston at the end of the cylinder. In the embodiment shown, the electronic sensors are inductive type switches. The other major components of the hydraulic system comprise a switching valve 23, pumps 24 and 25, a hydraulic fluid reservoir 26 and a pressure reservoir 27. The circuit as depicted in FIG. 2 is at a point during which pumping chamber 1 is discharging of material and hydraulic piston 18 is approaching the bottom of its stroke.

On the delivery conduit side, there is depicted a a pair of hydraulic cylinders 28 and 29 and a switching valve 30. Both switching valves 23 and 30 are electrically actuated, but may be actuated by other means such as by hydraulic, mechanical linkages, pneumatic or other actuating means. The circuit is depicted in FIG. 2 is at the point at which the conduit 8 is in front of chamber 1 which is discharging material.

In operation, pumping chamber 1 already charged with material (acting as a delivery chamber) is urged by hydraulic pressure exerted by means of its associated hydraulic unit 13 to discharge the material therein. Valve 23 is positioned such that hydraulic fluid from the pump 24 passes through hydraulic line 39 to the hydraulic cylinder 13, forcing the hydraulic piston 17 and therefore the pumping piston 6 to move. The pressurized hydraulic fluid provided via line 39 to the lower side of the hydraulic unit 13 urges the hydraulic piston 17 forward, and simultaneously hydraulic fluid is forced from the upper part 31 of the hydraulic cylinder 13 (i.e., the connecting shaft side of the hydraulic piston) through line 32 to the upper part 33 of cylinder 14, urging hydraulic piston 18 to pull pumping piston 7 away from the open end, port 3, of the pumping cylinder 2. While not depicted in FIG. 2, it is to be understood that the open ends of the pumping cylinders 1, 2 correspond to the ports 4, 3 as shown on FIG. 1, and are in fluid communication with the hopper, and thereby with the material to be pumped.

The components are arranged such that, when the currently pumping chamber is fully discharged, the hydraulic piston reaches the switch means 21, which sends a signal via conductor 51 to control means 55, which in turn send appropriate signals to valves 23 and 30 along via conductors 52, 53, causing them to change direction than that shown on FIG. 2 and cause hydraulic pressure to be switched from the bottoms of hydraulic cylinders 13 and 29 to hydraulic cylinders 14 and 28. This causes the conduit 8 to move in front of the chamber 2, and the pumping piston 7 in pumping chamber 2 to commence discharging material via the conduit 8 under the urging of hydraulic pressure through line 34, and concurrently, urge the pumping piston 6 in chamber 1 to commence moving back into its pumping chamber 1, thus drawing in material from the hopper (not shown) via the open port end 4. Chamber 2 thus becomes a delivery chamber and chamber 1 an intake chamber, which will operate in these roles until switch means 22 is actuated sending a signal via conductor 54 to the controller, causing the roles of chambers 1 and 2 to reverse.

In accordance with the preferred embodiment of the invention, the elements of a hydraulic circuit for making a pumping piston in a pumping chamber intaking material move to a fully charged condition before the delivery chamber has reached a fully discharged condition include an orifice 35 which causes a pressure drop across its inlet and outlet, an associated one-way valve 36, a two-way valve 37 and a relief valve 38. In operation, the two-way valve 37 permits the movement through the orifice 35 of hydraulic fluid in excess of that needed to drive back the hydraulic piston associated with the intake chamber. This ensures that the pumping chamber intaking material is filled more quickly and is ready for immediate discharge when the valves 23 and 30 change. When the fully charged position is reached, relief valve 38, which has been closed up to this point, opens and permits the excess hydraulic fluid to drain back to the reservoir 26. The process then repeats itself for the other pumping cylinder, which having just discharged it material, initiates its filling stroke.

Figure 3:
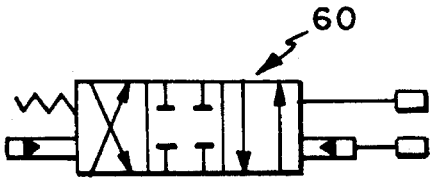
FIG. 3 is a diagammatic representation of a proportional-directional control valve which finds use with a preferred embodiment of the hydraulic circuit according to the invention.

In a variation on the embodiment of the invention just described, the switching-valve 23 is substituted with a proportional directional control valve 60 which has the flow schematics as shown on FIG. 3. In certain hydraulic circuits such a feature may be preferred over the use of the simpler switching valve 23 as is illustrated on FIG. 2. The use of such a proportional directional control valve 60 provides the same directional flow control as that of the switching valve, but further provides an effective means for limiting the volumetric flow rate passing through the valve which may be desirable in hydraulic control circuits according to the invention which further include transition-delivery control means. In a still further variation on the embodiment of the invention just described, the switching-valve 23 as depicted in FIG. 2 is utilized in conjunction with a variable flow controller means 40, such an an electrically responsive variable flow control valve which is preferably positioned between the outlet of pump 24 and the fluid inlet of switching valve 23. Such a variable controller means 40 is useful in variably limiting the supply of hydraulic fluid to the pistons, and is most preferably responsive to appropriate control signals transmitted via conductor 56 from the controller 55.

Figure 4:
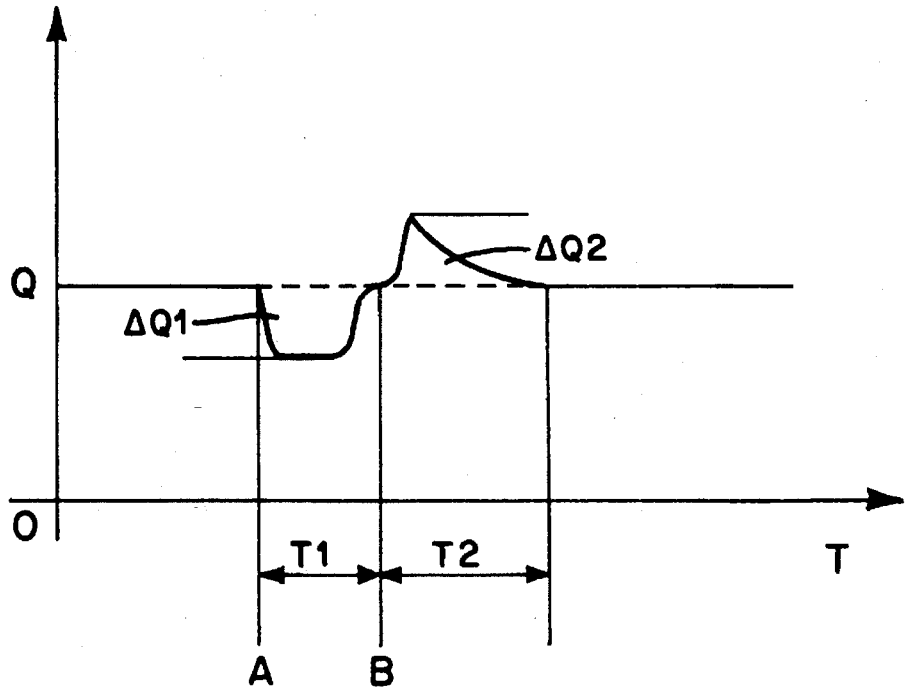
FIG. 4 (Prior Art)
FIG. 4 is a graph of quantity of pumped material against time, showing the effect of a manual transition-delivery control system.
Figure 5:
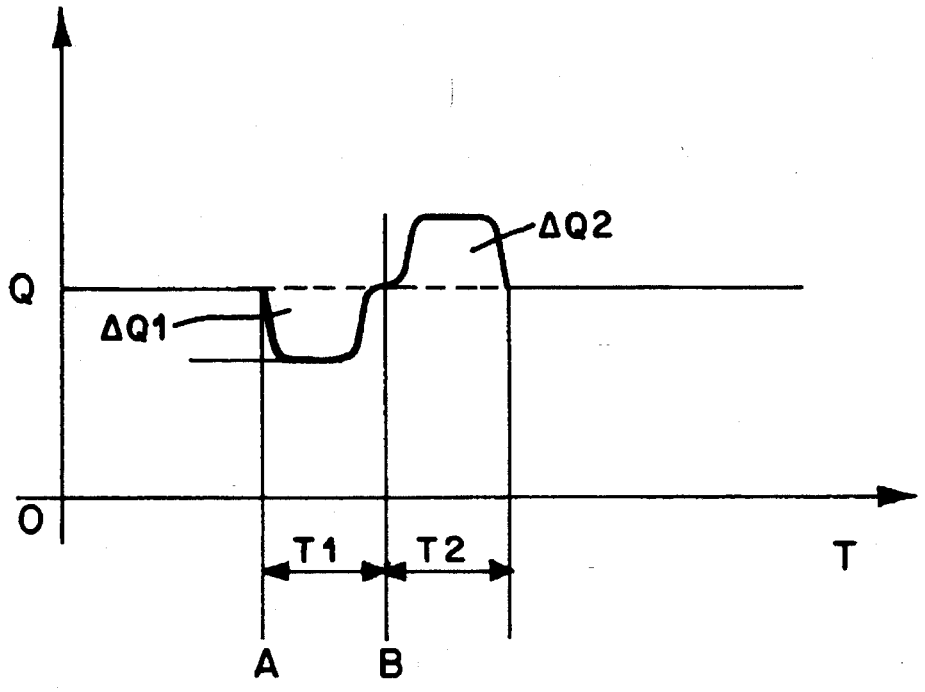
FIG. 5 is a graph of quantity of pumped material against time, showing the effect of a transition-delivery control achieved by an apparatus according to one aspect of the invention.

As has been described above, the apparatus according to the invention may further incorporate a "transition-delivery control" system whose function is to increase the rate of pumping of a delivery cylinder for a sufficient time so to raise the delivery volume or mass of the pumping cylinder by an amount $\Delta Q2$ in excess of the nominal delivery volume or mass Q, so to compensate for the drop off of material delivery by the apparatus during the end of the last discharge cycle, the quantity $\Delta Q1$. This relationship is most clearly illustrated on FIG. 5, wherein the nominal delivery rate of the apparatus is represented by the line indexed on the abscissa as Q, (the ordinate axis representing time) the reduction or drop off of material delivery is represented by the area indicated as $\Delta Q1$, and the amount necessary to compensate is indicated by the area indicated as $\Delta Q2$. As is shown in this optimal circumstance, the areas indicated are equal $\Delta Q1=\Delta Q2$. For comparitive purposes, FIG. 4 illustrates the operating and delivery characteristics of prior art devices. In such a manner as illustrated on FIG. 5, the rate of delivery of the pumped material may be quite uniform during the operation of the apparatus.

Various apparati may be used to effectuate the operation of the apparatus according to the invention so as to include such transition-delivery control means. In one embodiment, the controller 55 includes a timer circuit which is responsive to the operation of switch means 21 or 22. In such an embodiment, the controller 55 responds to the signal of one or the other of said switches which has been activated by the respective piston 17 or 18, which in turn initiates the operation of the timer circuit which for a set time interval, "t", transmits an appropriate output signal to the pump 24 which causes an increase in the volumetric output of the pump 24 which in turn will increase the delivery of the material by the amount $\Delta Q2$ being delivered by a delivery cylinder over the nominal volumetric delivery rate of Q. At the conclusion of this set time interval t, the output signal to the pump 24 is changed such that the pump operates to provide the nominal volumetric delivery rate, Q. As will be recognized by the skilled practitioner, the various variables which will determine the proper set time interval t will be a function of various process variables, including but not limited to: operating pressure of the apparatus, operating volume of the apparatus, viscosity and mass of the fluid being pumped, nominal volumetric delivery rate "Q" of the working apparatus, as well as other variables not elucidated here, however, it will also be recognized by the skilled practitioner that a suitable set time interval t may be established by empirical methods or by evaluative methods. In a further alternative to the the one described, the controller 55 responding to one or the other of said switch means 21 or 22 includes a timer circuit which, when initiated, transmits an output signal to a proportional directional control valve which is used as valve 23 in FIG. 2. In accordance with this embodiment, the operation of the proportional directional control valve is responsive to the output signal of the controller 55 and provides an increase in fluid flow from the pump 24 to a respective cylinder 13 or 14 for a sufficient time such that the delivery rate of the respective cylinder is increased to provide increased volumetric delivery $\Delta Q2$ as described above. As with the prior described embodiment, the control of the operation of the proportional directional control valve may be responsive to any appropriate signal, including but not limited to a set time interval signal t, or a different signal such as a proportional control signal generated by the controller 55. Particularly, one such different signal is that wherein the hydraulic fluid throughput of the valve is increased for a sufficient time to allow for the increased volumetric delivery described to occur. In a yet further embodiment similar to that just described, an electrically responsive flow control valve 40 (see FIG. 2) responsive to the controller 55 is used to increase the hydraulic fluid throughput. In a still further embodiment of the controller 55 providing a transition-delivery control system the controller 55 includes a programmable (digital or analog) control means, which may be a digital or analog computer, which is programmed to respond to an input signal, such as might be sent by a switch means 21 and 22, and provide an output control signal to an element of the apparatus, such as the pump 24 or the valve 23 (especially wherein the valve 23 is substituted by a proportional directional control valve which varying the volumetric delivery rate of the pump) for increasing the output of a delivery cylinder by an amount $\Delta Q2$ which to compensates for the drop off of delivery during the end of the last discharge cycle, the quantity $\Delta Q1$, preferably in accordance with the representation of FIG. 4 wherein is depicted that $\Delta Q1=\Delta Q2$. As will be recognized by the skilled practitioner, the various variables which will determine the proper set time interval t will be a function of various process variables, including but not limited to: operating pressure of the apparatus, operating volume of the apparatus, viscosity and mass of the fluid being pumped, nominal volumetric delivery rate "Q" of the working apparatus, as well as other variables not elucidated here. It will also be recognized by the skilled practitioner that a suitable program to govern the operation of the progammable control means in order to provide the operating characteristics of the apparatus as herein described is within the perview of the skilled practitioner in the art.

The invention is useful in any application where it is desired to provide a flow of fluid with a minimum of pulsation. The preferred embodiments of this invention are especially useful with thick or viscous fluids, such as concrete to be sprayed. The invention therefore also provides a concrete spraying apparatus comprising a pumping apparatus as hereinabove defined. The invention also provides a process of applying concrete by spraying wherein the spraying is effected by means of a pumping apparatus as hereinabove described.

We claim:

1. A pumping apparatus comprising:

a first cylindrical pumping chamber having an open end adapted to allow the entry of material to be pumped from a common hopper and in connection thereto, and a first movable piston within the pumping chamber connected by a shaft to first hydraulic piston within a first hydraulic piston and cylinder unit wherein the first hydraulic piston divides the interior of the first hydraulic piston and cylinder unit into an upper side and a lower side;

a second cylindrical pumping chamber having an open end adapted to allow the entry of material to be pumped from said common hopper and in connection thereto, and a second movable piston within the pumping chamber connected by a shaft to second hydraulic piston within a second hydraulic piston and cylinder unit wherein the second hydraulic piston divides the interior of the second hydraulic piston and cylinder unit into an upper side and a lower side;

a discharge conduit having two ends, one end of which is switchably connectable to the open end of either the first or second cylindrical pumping chamber;

and a hydraulic circuit which includes;

a first switching valve having an inlet connected by means of a hydraulic line to a supply of fluid and further having;

a first outlet connected by means of a hydraulic line to the lower side of the first hydraulic piston and cylinder unit and in fluid communication therewith, and, a second outlet connected by means of a hydraulic line to the lower side of the second hydraulic piston and cylinder unit and in fluid communication therewith, a first hydraulic line providing fluid communication with and connecting the upper side of the first hydraulic piston and cylinder unit with the upper side of the second hydraulic piston and cylinder unit and further with the inlet of pressure relief valve, and, a two-way valve having two inlets and one outlet, one inlet of which is in fluid connection with the hydraulic line connecting the the first outlet of the first switching valve and the lower side of the first hydraulic piston and cylinder unit, the second outlet of which is in fluid connection with the with the hydraulic line connecting the the second outlet of the first switching valve and the lower side of the second hydraulic piston and cylinder unit, and, the outlet of which is in fluid connection with a the said first hydraulic line.

2. The apparatus according to claim 1 which further includes:

a first fluid supply pump in fluid communication with and between the supply of fluid and the inlet of the first switching valve.

3. The apparatus according to claim 1 which further includes:

a third hydraulic cylinder having a piston therein and a shaft which is connected to the discharge conduit, a fourth hydraulic cylinder having a piston therein and a shaft which is connected to the discharge conduit, and, a second switching valve having an inlet in fluid communication by means of a hydraulic line to a supply of fluid, and having a first and a second outlet, the first outlet of which is in fluid communication with the third hydraulic cylinder by means of a first connect/rig hydraulic line, and, the second outlet of which is in fluid communication with the third hydraulic cylinder by means of a second connecting hydraulic line.

4. The apparatus according to claim 3 which further includes:

a second fluid supply pump in fluid communication with and between the supply of fluid and the inlet of the second switching valve.

5. The apparatus according to claim 1 wherein:

the first switching valve is an electrically actuated switching valve.

6. The apparatus according to claim 5 wherein:

the first switching valve is an electrically actuated proportional-directional type control valve.

7. The apparatus according to claim 1 which further comprises:

a variable flow control valve in fluid connection by means of a hydraulic line between the supply of fluid and the inlet of the first switching valve.

8. The apparatus according to claim 7 wherein:

the variable flow control valve is an electrically actuated variable flow control valve.

9. The apparatus according to claim 5 which further comprises:

a controller in signal communication with the first switching valve by way of a control signal conductor;

a first switch means mounted on the first hydraulic piston and cylinder unit and is responsive to the position of the first hydraulic piston within the hydraulic piston and cylinder unit, and in signal communication with the controller by way of a first switch signal conductor, a second switch means mounted on the second hydraulic piston and Cylinder unit and is responsive to the position of the second hydraulic piston within the hydraulic piston and cylinder unit, and in signal communication with the controller by way of a second switch signal conductor.

10. The apparatus according to claim 9 wherein:

the controller comprises a timer circuit responsive to the first switch means and the second switch means.

11. The apparatus according to claim 1 which further comprises:

concrete in the common hopper.

12. A process for the controlled delivery of a pumpable material which comprises the steps of:

providing a pumping apparatus comprising:

a first cylindrical pumping chamber having an open end adapted to allow the entry of material to be pumped from a common hopper and in connection thereto, and a first movable piston within the pumping chamber connected by a shaft to first hydraulic piston within a first hydraulic piston and cylinder unit wherein the first hydraulic piston divides the interior of the first hydraulic piston and cylinder unit into an upper side and a lower side;

a second cylindrical pumping chamber having an open end adapted to allow the entry of material to be pumped from said common hopper and in connection thereto, and a second movable piston within the pumping chamber connected by a shaft to second hydraulic piston within a second hydraulic piston and cylinder unit wherein the second hydraulic piston divides the interior of the second hydraulic piston and cylinder unit into an upper side and a lower side;

a discharge conduit having two ends, one end of which is switchably connectable to the open end of either the first or second cylindrical pumping chamber;

and a hydraulic circuit which includes;

a first switching valve having an inlet connected by means of a hydraulic line to a supply of fluid and further having;

a first outlet connected by means of a hydraulic line to the lower side Of the first hydraulic piston and cylinder unit and in fluid communication therewith, and, a second outlet connected by means of a hydraulic line to the lower side of the second hydraulic piston and cylinder unit and in fluid Communication therewith, a first hydraulic line providing fluid communication with and connecting the upper side of the first hydraulic piston and cylinder unit with the upper side of the second hydraulic piston and cylinder units and further with the inlet of pressure relief valve, and, a two-way valve having two inlets and one outlet, one inlet of which is in fluid connection with the hydraulic line connecting the the first outlet of the first switching valve and the lower side of the first hydraulic piston and cylinder unit, the second outlet of which is in fluid connection with the with the hydraulic line connecting the the second outlet of the firsts switching valve and the lower side of the second hydraulic piston and cylinder unit, and, the outlet of which is in fluid connection with a the said first hydraulic line, and;

operating the hydraulic circuit to bring the first pumping piston to a position within the first cylindrical pumping chamber wherein iris fully charged with material to be pumped from the common hopper prior to the complete discharge of the material from the second pumping piston.

13. The process according to claim 12 which includes the further process steps of:

providing a controller in signal communication with the first switching valve by way of a control signal conductor;

providing a first switch means mounted on the first hydraulic piston and cylinder unit and is responsive to the position of the first hydraulic piston within the hydraulic piston and cylinder unit, and in signal communication with the controller by way of a first switch signal conductor, providing a second switch means mounted on the second hydraulic piston and cylinder unit and is responsive to the position of the second hydraulic piston within the hydraulic piston and cylinder unit, and in signal communication with the controller by way of a second switch signal conductor, and, operating the controller to temporarily increase the rate of pumping of the first cylindrical pumping chamber which is pumping material for a time sufficient to increase the delivery rate of the material being pumped in an mount in excess of the nominal delivery rate of the cylindrical pumping such that the increased mount of delivered material provided during the period of temporary increase in pumping is approximately equal to the difference between the nominal delivery rate of second cylindrical pumping chamber and the actual reduced mount of material delivered by the second cylindrical pumping chamber near the conclusion of the pumping stroke of the second cylindrical pumping chamber.

* * * * *